US006561105B2

(12) United States Patent
Godin et al.

(10) Patent No.: US 6,561,105 B2
(45) Date of Patent: May 13, 2003

(54) RAIL VEHICLE HAVING A DRIVER'S CAB PROVIDED WITH AN ENERGY-ABSORBING STRUCTURE ADAPTED TO COPE WITH A COLLISION ABOVE THE FRAME OF THE VEHICLE

(75) Inventors: Marcel Godin, Valenciennes (FR); Gérard Gielczinski, Lourches (FR); Jean-Marc Langlet, Sameon (FR); Christian Boneill, Raismes (FR); Isabelle Guilloteau, Valenciennes (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/995,581

(22) Filed: Nov. 29, 2001

(65) Prior Publication Data

US 2002/0073887 A1 Jun. 20, 2002

(30) Foreign Application Priority Data

Dec. 18, 2000 (FR) ..... 00 16493

(51) Int. Cl.[7] ..... B61D 17/00

(52) U.S. Cl. ..... 105/396; 105/392.5; 188/371; 296/189; 296/190.03

(58) Field of Search ..... 105/392.5, 396; 188/371, 374, 377; 296/188, 189, 190.01, 190.03, 190.08

(56) References Cited

U.S. PATENT DOCUMENTS

| | | | | | |
|---|---|---|---|---|---|
| 3,599,757 | A | * | 8/1971 | Takamatsu et al. | 188/371 |
| 4,272,114 | A | * | 6/1981 | Hirano et al. | 188/377 |
| 4,715,292 | A | * | 12/1987 | Pavlick et al. | 105/392.5 |
| 5,443,146 | A | * | 8/1995 | Ayyildiz et al. | 188/371 |
| 6,158,356 | A | * | 12/2000 | Hachet et al. | 105/392.5 |
| 6,167,815 | B1 | * | 1/2001 | Werner et al. | 105/392.5 |
| 6,196,135 | B1 | * | 3/2001 | Kashima et al. | 105/392.5 |
| 6,393,999 | B1 | * | 5/2002 | Schneider | 105/392.5 |

FOREIGN PATENT DOCUMENTS

| | | |
|---|---|---|
| EP | 0 802 100 A | 10/1997 |
| EP | 0 888 946 A | 1/1999 |
| EP | 0 936 118 A | 8/1999 |
| EP | 0 952 063 A | 10/1999 |

* cited by examiner

*Primary Examiner*—S. Joseph Morano
*Assistant Examiner*—Lars A. Olson
(74) *Attorney, Agent, or Firm*—Sughrue Mion, PLLC

(57) ABSTRACT

A rail vehicle having an end provided with a driver's cab, said vehicle having a rigid frame extending under said driver's cab, said rail vehicle having a protective shield disposed in front of said driver's cab and provided with a rigid structure, said protective shield resting on said frame and being connected to said frame via at least one energy-absorbing element interposed locally between the shield and the frame.

11 Claims, 2 Drawing Sheets

RAIL VEHICLE HAVING A DRIVER'S CAB PROVIDED WITH AN ENERGY-ABSORBING STRUCTURE ADAPTED TO COPE WITH A COLLISION ABOVE THE FRAME OF THE VEHICLE

The invention relates to the field of construction of vehicles, in particular rail vehicles having driver's cabs, and it relates to such a vehicle that has an energy-absorbing structure for protecting the driver of the vehicle in the event of collision.

BACKGROUND OF THE INVENTION

Current rail vehicles are equipped at their ends with means serving to withstand stresses to which the vehicle is subjected under normal running conditions and when "docking" impacts occur at low speeds.

It is also known, from Document FR-A-2 698 840, that it is possible to equip rail vehicles having driver's cabs with energy-absorbing metal structures for the purpose of protecting the passengers and the driver of the vehicle in the event it is subjected to major impacts, e.g. when it collides with another train. The vehicle then has dynamic plastic deformation zones formed of fixed or interchangeable energy-absorbing elements that are provided at the ends of the vehicle.

However, such a structure is adapted to absorb energy from a major impact at the level of the solebars of the vehicle frame, but it is not adapted to coping with an impact with an obstacle that hits the driver's cab of the rail vehicle above the level of the frame. Such an impact can occur when an obstacle hits the rail vehicle directly level with the driver's cab, and it can also occur when the impact is with an obstacle for which the energy-absorbing elements of the frame are overdimensioned and cannot therefore absorb the impact properly. In such a case, the high rigidity of the frame and the downward-sloping shape of the end of the train usually cause the obstacle that is hit to be lifted up so that it then strikes the driver's cab and causes uncontrolled deformation thereof, thereby threatening the life of the driver.

OBJECTS AND SUMMARY OF THE INVENTION

An object of the present invention is to mitigate these drawbacks by providing a rail vehicle whose driver's cab is provided with a protective shield that is adapted to absorb the energy from an impact with an obstacle that hits the driver's cab above the level of the solebars of the vehicle frame, and that is simple and inexpensive to implement.

The invention provides a rail vehicle having an end provided with a driver's cab, said vehicle having a rigid frame extending under said driver's cab, said rail vehicle having a protective shield disposed in front of said driver's cab and provided with a rigid structure, said protective shield resting on said frame and being connected to said frame via at least one energy-absorbing element interposed locally between the shield and the frame.

In particular embodiments, the rail vehicle of the invention may comprise one or more of the following characteristics taken in isolation or in any technically-feasible combination:

the one or more energy-absorbing elements connect the protective shield longitudinally to the frame so as to enable the protective shield to move relative to the frame in a longitudinal direction of the vehicle by the one or more energy-absorbing elements deforming when a frontal impact occurs;

at their interface, the frame and the protective shield have complementary shapes constituting a guide device of the runner type in the longitudinal direction of the vehicle;

the protective shield is constituted of a rigid structure extending vertically over the height of the driver's cab, and provided with an opening facing the windscreen of the vehicle;

the protective shield also extends over the sides of the driver's cab to form a casing structure;

the protective shield and the frame are locally connected directly to each other via break-away fixing elements;

the top portion of the protective shield is connected via energy-absorbing elements to structural elements secured to or integral with the frame;

the front face of the protective shield supports energy-absorbing elements extending towards the front end of the vehicle;

the front end of the frame supports energy-absorbing elements;

the one or more energy-absorbing elements are constituted by structures that deform in programmed manner; and the front end of the frame supports a track-clearing guard iron.

BRIEF DESCRIPTION OF THE DRAWINGS

The objects, features, and advantages of the present invention are better understood from the following description of a particular embodiment of the invention given by way of non-limiting example and with reference to the accompanying drawings, in which.

MORE DETAILED DESCRIPTION

To make the drawings clearer, only those elements which are necessary to understanding the invention are shown. Like elements have like references from one figure to another.

Figure 1:
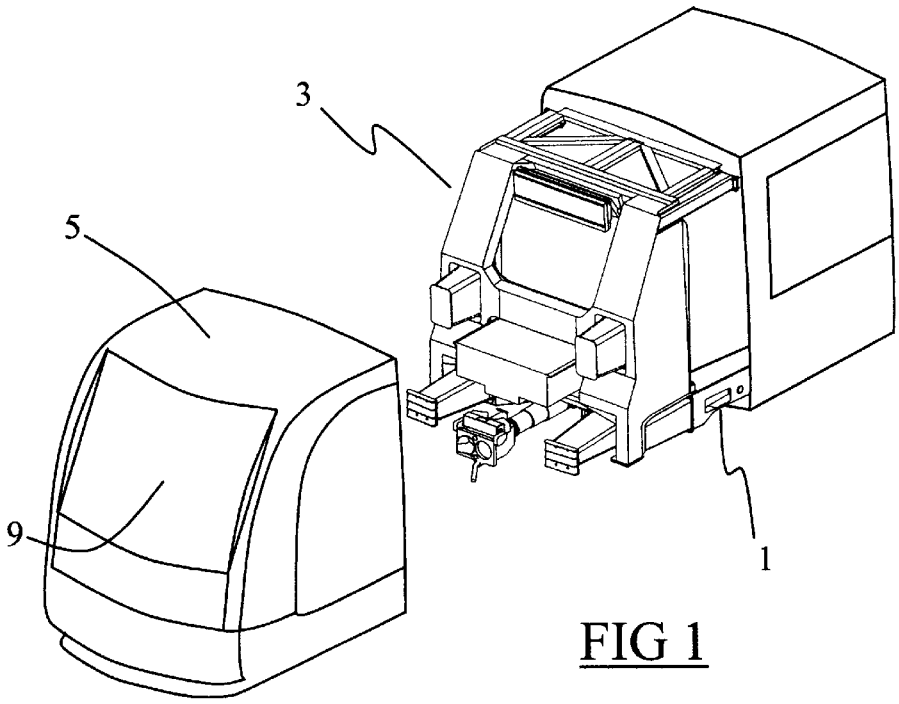
FIG. 1 is a partially-exploded perspective view of one end of a rail vehicle, as equipped with a structure of the invention.

FIG. 1 shows the front end of a rail vehicle having a non-deformable rigid frame 1 providing rigidity for the vehicle, and a skin 5 forming an aesthetically-pleasing casing for the vehicle and supporting a windscreen 9.

The vehicle is equipped with a driver's cab provided with a structure for protecting the driver. The structure is shown in exploded manner in FIG. 2 and is interposed between the inside of the driver's cab and the portion of the skin 5 that defines the front face of the vehicle. This structure has a rigid protective shield 3 that is non-deformable, that has a front wall extending vertically over substantially the entire height of the driver's cab, and that has two side walls 3*b* extending on either side of the driver's cab. The front wall 3*a* is provided with a wide opening 10 facing the windscreen 9 of the vehicle and offering a good field of vision to the driver.

Figure 2:
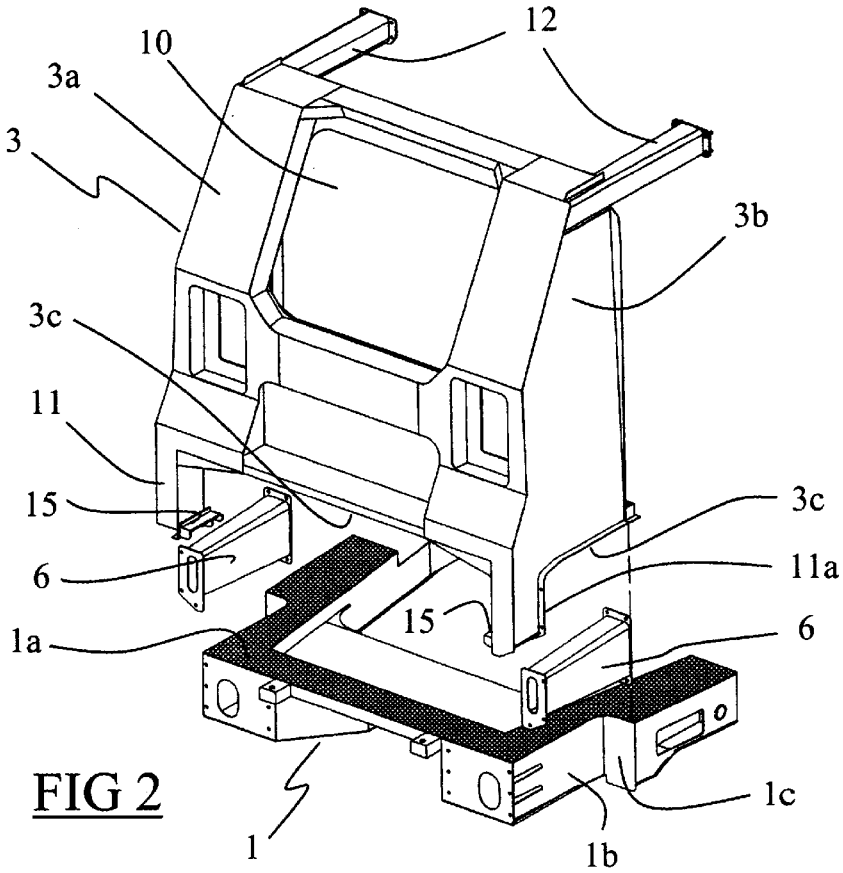
FIG. 2 is a larger-scale exploded perspective view of a portion of the structure forming the front end of the vehicle of FIG. 1.
Figure 3:
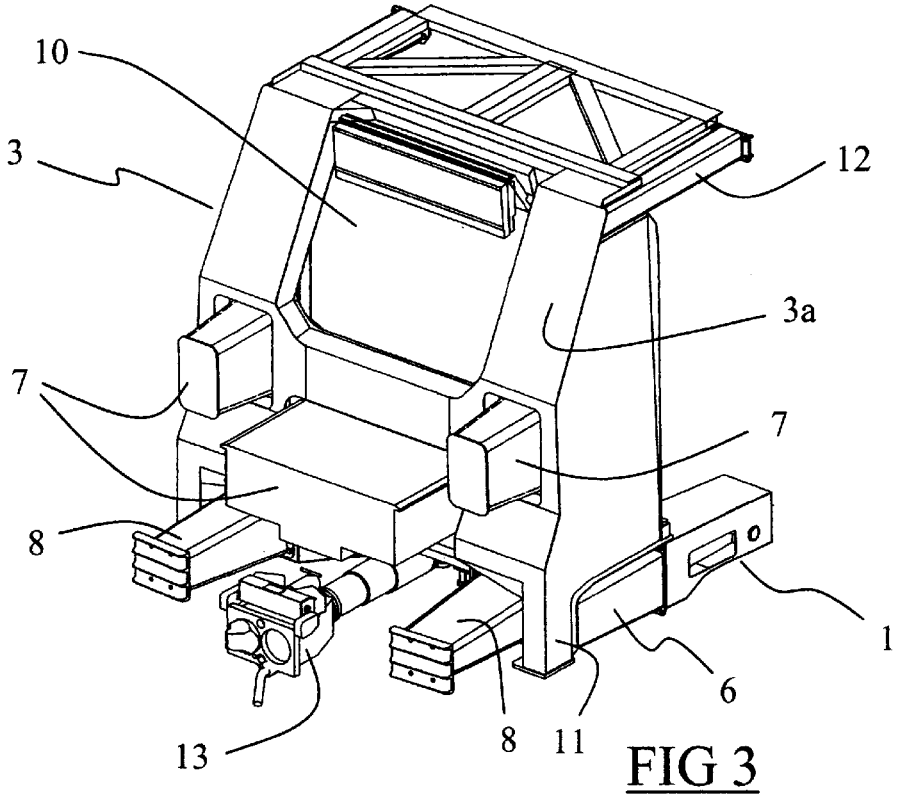
FIG. 3 is a perspective view of the structure forming the front end of the vehicle of FIG. 1 prior to being subjected to an impact.

As shown in FIGS. 2 and 3, the protective shield 3 has a baseplate 3*c* resting on a plane top surface 1*a* of the frame 1, and it has two guide arms 11 extending respective ones of the two side walls 3*b* of the protective shield 3 downwards. Each guide arm 11 extends vertically in the vicinity of a solebar 1*b* of the frame 1, and has a bottom end provided with a lip 15 extending under the solebar 1*b* to form an anti-lifting abutment preventing the protective shield 3 from lifting away from the frame 1.

The protective shield 3 is connected longitudinally to the frame 1 at each guide arm 11 via a deformable spacer 6 interposed between a rear face 11*a* of the guide arm 11, and an abutment face 1*c* belonging to a shoulder of the frame 1 that is disposed facing the rear face 11*a* of the guide arm 11. In the embodiment shown, the deformable spacer 6 is advantageously in the form of an assembly of metal sheets that deform plastically in programmed manner, and that have longitudinal ends provided with respective flanges enabling them to be fixed by bolting.

At its top, the protective shield 3 also has two link girders 12 extending towards the rear of the vehicle and connected to a structural ring (not shown in the figures) supported by the frame 1 of the vehicle. The two link girders 12 are made up of assembled-together metal sheets that deform plastically in programmed manner and that form energy-absorbing elements having strength properties substantially equivalent to those of the deformable spacers 6.

Advantageously, the protective shield 3 is held on the frame 1 locally by break-away bolts that are not shown in the figures.

As shown in FIG. 3, the front face of the front wall 3*a* of the protective shield 3 supports a set of energy-absorbing "crumple boxes" 7 projecting towards the front face of the vehicle. Preferably, the crumple boxes 7 are weaker than the spacers 6 and the link girders 12, so that, in the event of impact, the set of crumple boxes 7 are deformed progressively before the spacers 6 and the link girders 12 start to deform.

The front end of the frame 1 of the vehicle is conventionally equipped with two anti-overriding energy-absorbing abutments 8 which are disposed in alignment with the solebars 1*b*, on either side of an automatic coupling 13 constituted by a coupling head connected to a headstock of the frame 1 via an energy-absorbing element. The anti-overriding energy-absorbing abutments 8 have very high strength properties that are adapted to absorbing the quantities of energy involved when the vehicle collides with another rail vehicle.

Figure 4:
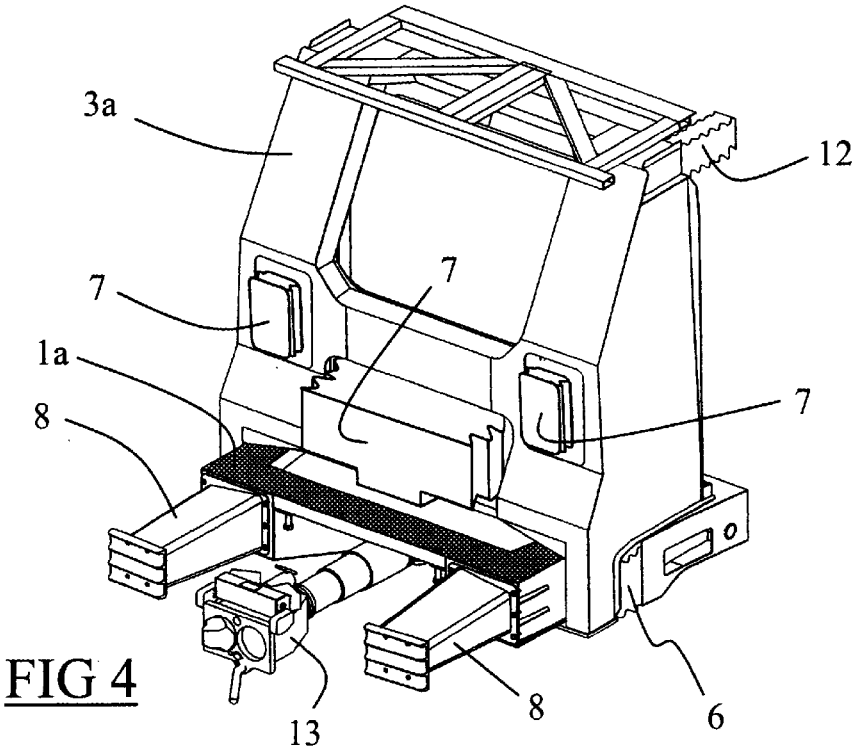
FIG. 4 is a view analogous to the view of FIG. 3, after an impact has occurred level with the driver's cab of the rail vehicle.

FIG. 4 shows the deformation of the structure of the vehicle as described above after an impact with an obstacle that has hit the front face of the vehicle above the level of the solebars 1*b* of the frame 1, substantially level with the crumple boxes 7 supported by the front face of the protective shield 3.

As shown in FIG. 4, when such an impact occurs, the crumple boxes 7 of the front face of the protective shield 3 crumple up, thereby absorbing a portion of the energy from the impact, and the residual energy from the impact is absorbed by the spacers 6 and the link girders 12 deforming progressively, thereby causing the protective shield 3 to move rearwards relative to the frame 1, the protective shield 3 being guided on the frame 1 throughout its movement by the two guide arms 11.

Such progressive movement of the protective shield 3 makes it possible for the energy from the impact to be absorbed while also conserving the structural integrity of the protective shield 3, thereby guaranteeing a survival space for the driver who remains at all times sheltered behind the protective shield 3. As can be seen in the figure, the rearward movement of the protective shield 3 takes place over a stroke that cannot be longer than a given maximum stroke, since the abutment face 1*c* of the frame 1 co-operates with the guide arms 11 to prevent the shield 3 from moving beyond the normal range of absorption by the spacers 6 crumpling up.

To guarantee greater safety inside the driver's cab 1, said cab is fitted out so that the protective shield 3 moving rearward over the spacer crumple range does not injure the driver. Thus, the vehicle control panel (not shown) is advantageously fixed to the protective shield 3 so that it remains integrated therewith in the event of impact, thereby preventing elements from being deformed and from becoming projectiles. The driver's seat may also be secured to the protective shield 3 so as to move simultaneously with the protective shield.

Such a vehicle thus offers the advantage of guaranteeing high driver safety by enabling an impact that takes place level with the cab to be absorbed by the protective shield moving rearwards in controlled manner, the protective shield retaining its structural integrity and at all times performing its function as a protective shield.

Such a vehicle also offers the advantage of having a non-deformable rigid frame that extends to the vicinity of the front face of the vehicle. It is thus possible to fix a guard iron (not shown in the figures) in the vicinity of the front of the vehicle by fixing it directly under the rigid frame, thereby preventing it from disturbing the behavior of the vehicle.

Naturally, the invention is in no way limited to the embodiment that is described and shown, and that is given merely by way of example. Modifications remain possible, in particular as regards how the various elements are made, or by replacing techniques with equivalent techniques, without going beyond the scope of protection of the invention.

What is claimed is:

1. A rail vehicle having an end provided with a driver's cab, said vehicle having a rigid frame extending under said driver's cab, said rail vehicle having a protective shield disposed in front of said driver's cab and provided with a rigid structure, said protective shield resting on said frame and being connected to said frame via at least one energy-absorbing element interposed locally between said protective shield and said frame.

2. A rail vehicle according to claim 1, wherein said energy-absorbing elements connect said protective shield longitudinally to said frame so as to enable said protective shield to move relative to said frame in a longitudinal direction of said rail vehicle by said energy-absorbing elements deforming when a frontal impact occurs.

3. A rail vehicle according to claim 2, wherein, at their interface, said frame and said protective shield have complementary shapes constituting a guide device of the runner type in the longitudinal direction of said rail vehicle.

4. A rail vehicle according to claim 1, wherein said protective shield is constituted of a rigid structure extending vertically over the height of said driver's cab, and provided with an opening facing the windscreen of said rail vehicle.

5. A rail vehicle according to claim 4, wherein said protective shield also extends over the sides of said driver's cab to form a casing structure.

6. A rail vehicle according to claim 1, wherein said protective shield and said frame are locally connected directly to each other via break-away fixing elements.

7. A rail vehicle according to claim 1, wherein the top portion of said protective shield is connected via energy-absorbing elements to structural elements secured to or integral with said frame.

8. A rail vehicle according to claim 1, wherein the front face of said protective shield supports energy-absorbing elements extending towards the front end of said rail vehicle.

9. A rail vehicle according to claim 1, wherein the front end of said frame supports energy-absorbing elements.

10. A rail vehicle according to claim 1, wherein said energy-absorbing elements are constituted by structures that deform in a programmed manner.

11. A rail vehicle according to claim 1, wherein the front end of said frame supports a guard iron.

* * * * *